United States Patent [19]

Gilham et al.

[11] Patent Number: 4,759,283

[45] Date of Patent: Jul. 26, 1988

[54] VALUE SELECTION MECHANISM FOR POSTAL FRANKING MACHINES

[75] Inventors: Dennis T. Gilham, Ongar; Peter P. Page, Bishops Stortford; David A. Gawler, Hutton, all of United Kingdom

[73] Assignee: Alcatel Business Systems Limited

[21] Appl. No.: 881,346

[22] Filed: Jul. 2, 1986

[30] Foreign Application Priority Data

Jul. 4, 1985 [GB] United Kingdom ..... 8516921

[51] Int. Cl.[4] ..... B41L 7/00

[52] U.S. Cl. ..... 101/91; 101/110; 400/185; 74/58; 74/89.15; 74/424.8 A

[58] Field of Search ..... 101/91, 45, 110; 400/185, 317.1, 186; 74/58, 59, 424.8 A, 354, 89.15

[56] References Cited

U.S. PATENT DOCUMENTS

| | | | |
|---|---|---|---|
| 3,188,897 | 6/1965 | De Valliere | 74/424.8 A |
| 3,930,569 | 1/1976 | Boyden | 400/372 |
| 4,041,793 | 8/1977 | Repay et al. | 74/424.8 A |
| 4,078,484 | 3/1978 | Horbal et al. | 101/91 |
| 4,121,473 | 10/1978 | Schubert et al. | 101/91 |
| 4,159,813 | 7/1979 | Yale | 74/58 |
| 4,181,443 | 1/1980 | Hirabayashi et al. | 400/317.1 |
| 4,265,142 | 5/1981 | Watanabe | 74/354 |
| 4,436,031 | 3/1984 | Hori | 400/185 |
| 4,461,588 | 7/1984 | Watanabe et al. | 400/185 |
| 4,603,627 | 8/1986 | Pollak, Jr. et al. | 101/91 |
| 4,608,923 | 9/1986 | Muller | 101/91 |

*Primary Examiner*—William Pieprz

*Attorney, Agent, or Firm*—Shoemaker and Mattare, Ltd.

[57] ABSTRACT

To enable a single motor in a franking machine to set the printing wheels in a printing drum in addition to rotating the drum and feeding items of mail through the machine, four carriages, each carrying a rocker and solenoids are mounted on two pairs of continuously rotating lead screws. Each carriage is connected by a ring shoe to a printing wheel via a selecting bar in the drum arbor. Solenoid moves rocker to engage screw to drive the carriage in one direction. Movement in the opposite direction is by screw controlled by solenoid. Each carriage sets an encoding switch to enable a microcomputer to know the state of the printing wheels. Each new value is fed, for example, by a keyboard, to the microcomputer which determines the movement, if any, of each carriage to set the new value on the printing wheels.

7 Claims, 6 Drawing Sheets

VALUE SELECTION MECHANISM FOR POSTAL FRANKING MACHINES

FIELD OF THE INVENTION

This invention relates to value selection mechanisms for franking machines.

In a franking meter a value has to be set for each item of mail fed into the machine. This value which is usually up to 9999, can be altered as required. This value is automatically communicated to a mechanism that prints on items of mail an inked franking impression in accordance with the requirements laid down by International Post Offices. The value is also automatically communicated to an accounting side of the meter, including a descending register containing the sum of postage value remaining credited to the customer and an ascending register containing the accumulated sum of postage value used.

It will be appreciated that the accounting and control side of the meter can be basically an electronic system while the value setting may be electromechanical or mechanical and the printing system essentially mechanical.

DESCRIPTION OF PRIOR ART

In the case of mechanical value setting mechanisms, although these have cost advantages over electromechanical systems they are limited to manual operation only. Electromechanical value setting systems are able to be set remotely under the control of electronic signals. This is of considerable benefit when the franking machine is a part of a mailing system involving the use of devices such as weighscales. Prior proposals comprising such electromechanical systems have used a plurality of stepping motors, one for each numerical order, or one stepping motor selectively connected to printing wheels under the control of solenoids. Stepping motors are bulky and require considerable space within the meter housing. The use of a single stepping motor with control solenoids involves substantial complexity. Both these systems are costly to manufacture.

In Patent Specification No. GB 1 564 234 a system has been proposed whereby rotary motion is derived from that portion of a franking machine which continuously rotates for the purpose of driving a print drum and that motion is applied to the drum also to drive value selection mechanisms under the control of solenoids. This facilitates automatic value selection without the need of stepping motors but imposes a substantial load on the motor.

SUMMARY OF INVNETION

A primary object of this invenion is to provide a franking meter having an electronic accounting system and a mechanical printing system in which each value to be franked is set simultaneously in the two systems by automatic means that are substantially more simple, economically constructed and more readily serviced than in the case of the aforesaid prior proposals.

According to the invention, a postal franking machine comprises a single driving motor, a printing drum, means for connecting as required the drum to the driving motor for a single cycle to make franked impressions on items of mail, means continuously driven by the motor during the operation of the machine, and means controlled by electronic control means for setting different values to be printed by the drum under power derived from said continuously driven means which electronic control means is arranged to receive prior to said single cycle, input signals specifying new values whereby, in each operation of the machine, motor power is not used simultaneously for making franked impressions and for setting different values to be printed.

According to another aspect of the invention there is a value selection mechanism for a postal franking machine comprising a rotary member for connection to a single source of power arranged so as to be rotated continuously during the operation of the machine, in the printing drum mechanism both means for connecting as required the printing drum to the rotary member for a single cycle to make franked impressions on items of mail and mechanical means rotatable with the drum for setting when the drum is stationary, a value to be franked by a printing unit in the drum, a value selection unit mounted for movement independently of the printing drum for actuating the said mechanical means to set the printing unit to the required franking value, electrically controlled means for connecting each value selection unit independently of any other value selection unit to the said rotary member, and electronic control means responsive to the position of the value selection unit and to the required franking value input to the electronic control means for actuating the electrically-controlled means to position a franking value unit to set said printing unit according to the input value. Very conveniently, the value selection units are carriages respectively mounted to travel to and fro along straight lines parallel to the drum axis, each carriage being mounted on an individual pair of lead screws continuously rotated by said rotary member during the operation of the machine and each carriage being provided with electrically controlled means for connecting the carriage to one of the lead screws for moving the carriage in one direction and alternatively to the other of the lead screws for moving the carriage in the other direction.

The electronic control means may advantageously comprise a central processing unit which is enabled to register the temporary positions of the carriages and, therefore, of the printing units, by signals received from as many encoding switches as there are carriages, each encoding switch being connected by a gear and rack to its associated one of the carriages.

BRIEF DESCRIPTION OF DRAWINGS

In order that the invention may be clearly understood and readily carried into effect, a value selector mechanism for a postal franking machine will now be described, by way of example, with reference to the accompanying drawings, in which.

DETAILED DESCRIPTION OF PREFERRED EMBODIMENT

Figure 3:
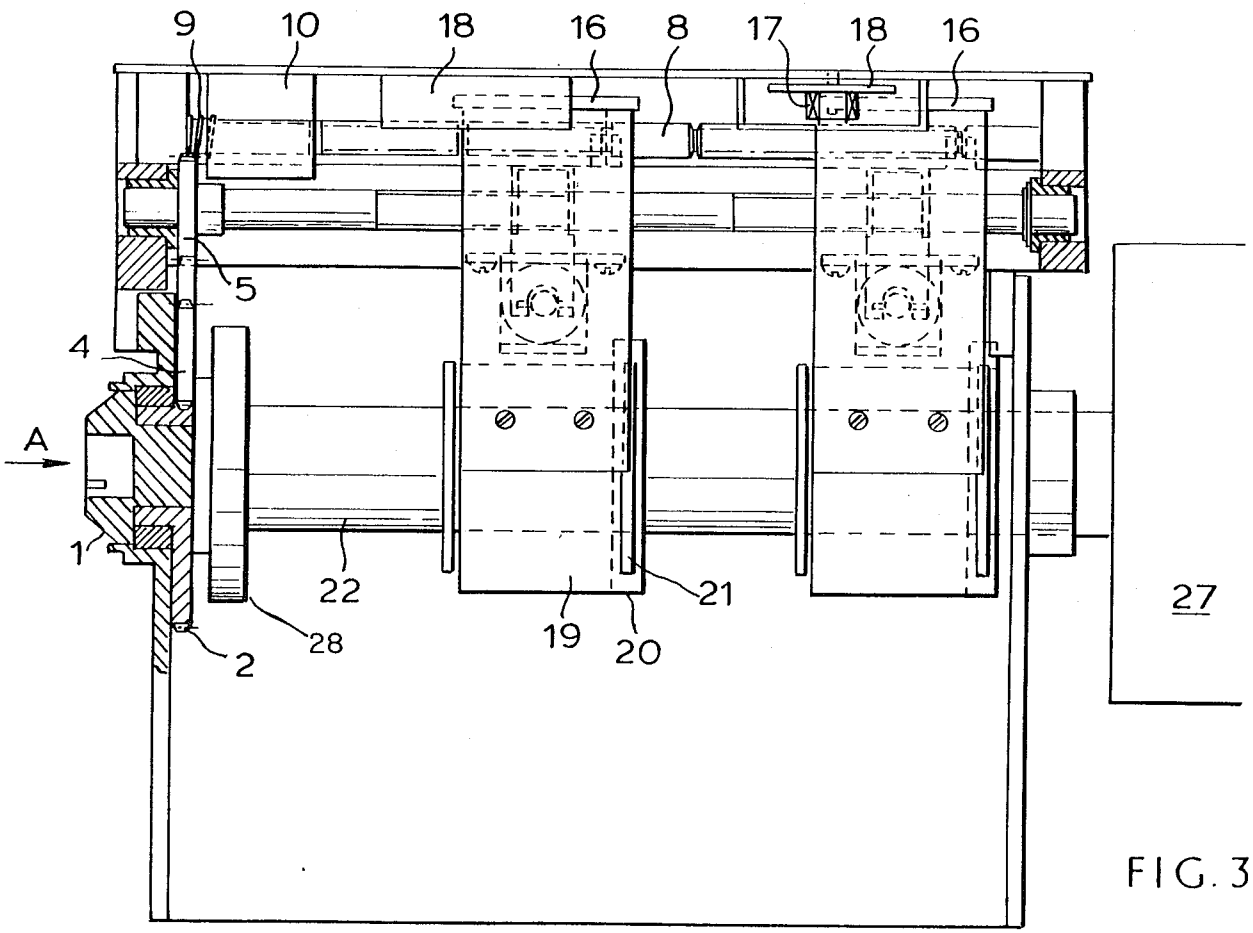
FIG. 3 is a vertical section showing a postal franking meter comprising the value selection mechanism.
Figure 4:
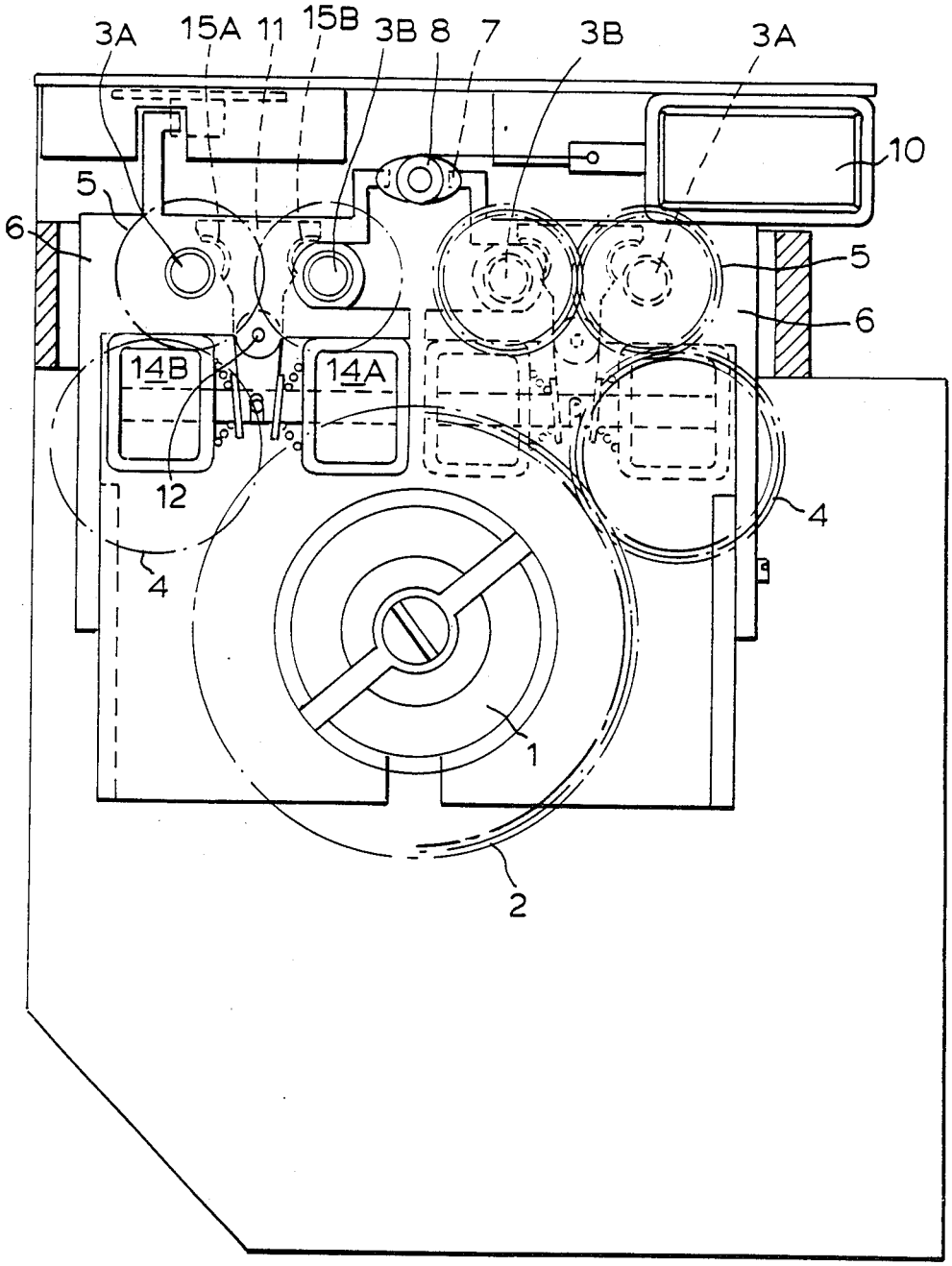
FIG. 4 is a view of the franking meter of FIG. 3 as viewed in the direction of the arrow A in FIG. 3.
Figure 5:
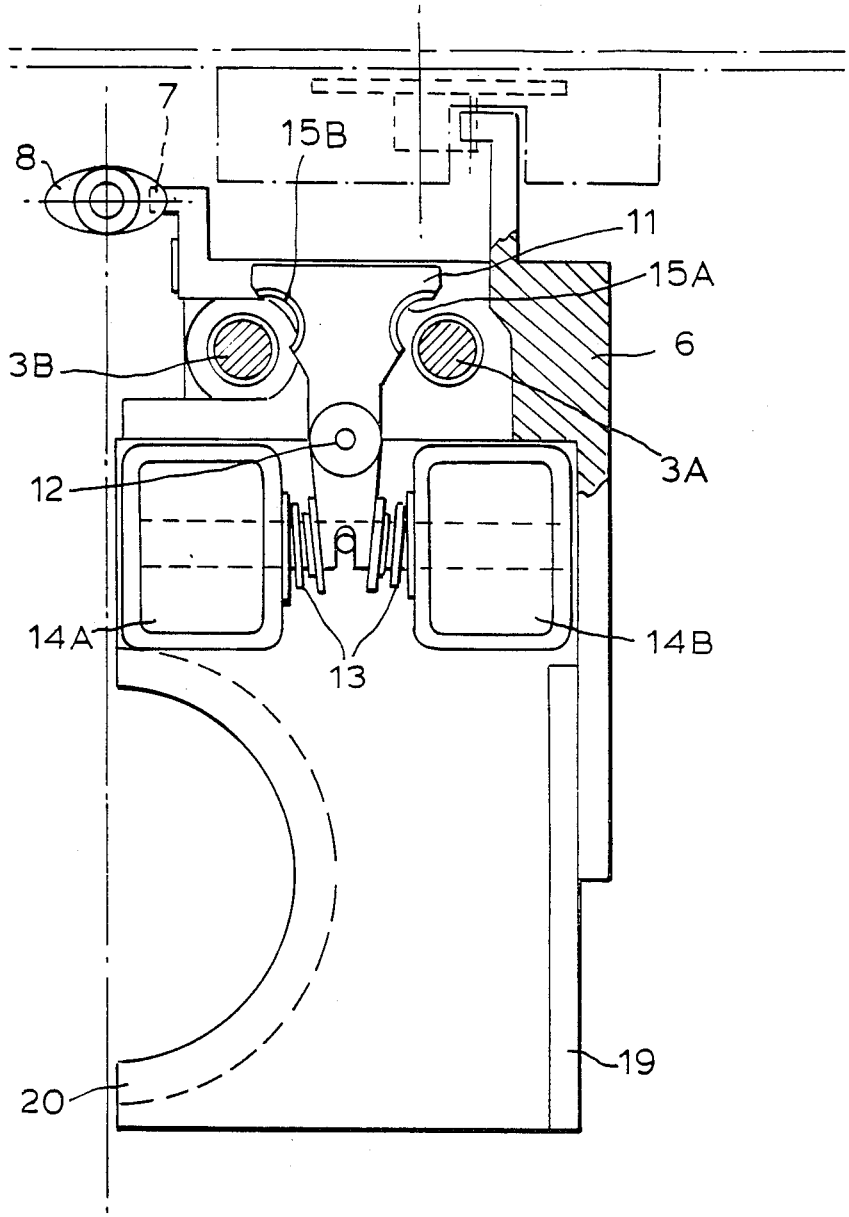
FIG. 5 is a part-sectional view of a portion of the value selector mechanism.

Referring to FIGS. 1 to 5, the drive for an electronic franking meter is input by way of a drive dog 1 from a motor (not shown) which may be in a base on which the franking meter is mounted. When the franking machine is ready for use, an input gear 2 integral with the dog 1 rotates continuously driving two pairs of driven gears 5 shown in FIG. 4 respectively by way of two idler gears 4. The two driven gears 5 in each pair respectively drive two lead screws 3A, 3B which rotate in opposite directions. Therefore, as shown in FIG. 4, there are, in the upper part of the meter, two pairs of lead screws 3A, 3B and four value selection carriages 6 are mounted to slide along the four lead screws two on each pair of screws. The value selection carriages 6 are mounted to be driven selectively and independently of one another, the lead screws in each pair being used one at a time for controlled periods to drive each carriage 6, along a selected one of the two alternative directions.

Integral with each of the carriages 6 is a yoke 19 carrying a value selector ring show 20 (FIG. 5) which shrouds and is capable of imparting axial movement to an associated one of four selector rings 21 (FIG. 1) which can slide along an arbor 22 under the control of the associated one of four selector rings 21 (FIG. 1) is fixed to a bar 23 that can slide longitudinally in a slot on the arbor 22 and carries a rack 24 in mesh with a gear 25 fixed to a printing wheel 26 in a printing drum 27. When the four printing wheels 26 have been set, rotary movement of the drum causes the characters selected by the positioning of the wheels to traverse and print on an item of mail fed beneath the drum along the base of the machine.

The aforesaid motor in the base drives the printing drum 27 by way of a single revolution clutch 28 when a franked impression is required and it also drives the mechanism for feeding items of mail through the machine. The postage values are selected when the printing drum 27 is at rest and no items of mail are being fed through the machine. Therefore adequate motor power is available for the postage value selection by way of the value selection carriages 6. This applies also to smaller machines in which the franking meter, instead of being detachable from the mail feeding mechanism, is integral with that mechanism.

As the four mechanisms for moving the bar value selection carriages 6 along their respective pairs of lead screws 3A 33 are the same, only one need be described in detail. A rocker 11 (FIG. 5) on a pivot 12 is mounted in each carriage 6 and is held in a central position by springs 13 unit the carriage 6 is required to be moved by one of its lead screws 3A, or 3B. Integral with each carriage are two solenoids 14A, 14B. When the solenoid 14A is energised, this causes the rocker 11 to swing over until partial helical threads in a half nut 15A engage the helical thread on the lead screw 3A. Thus the rotation of the lead screw causes linear motion of the carriage. Reverse motion is obtained by energisation of the solenoid 14B to cause a half nut 15B on the rocker 11 to engage the lead screw 3B.

Integral with each carriage 6 is a rack 16 (FIG. 2) which engages a gear 17 that forms part of an associated one of four encoding switches 18. These encoding switches are as described in UK patent specification No. 2034991. The positions of the four racks 16 when stationary correspond to the values set to be printed by the associated four printing wheels 26, these being allocated to units, tens, hundreds and thousands orders. When the carriages 6 are moved, each in the required direction or left stationary, by the appropriate energisation of their solenoids 14A, 14B to set a new value to be printed, the setting of the encoding switches 18 is correspondingly adjusted to the new value.

Figure 1:
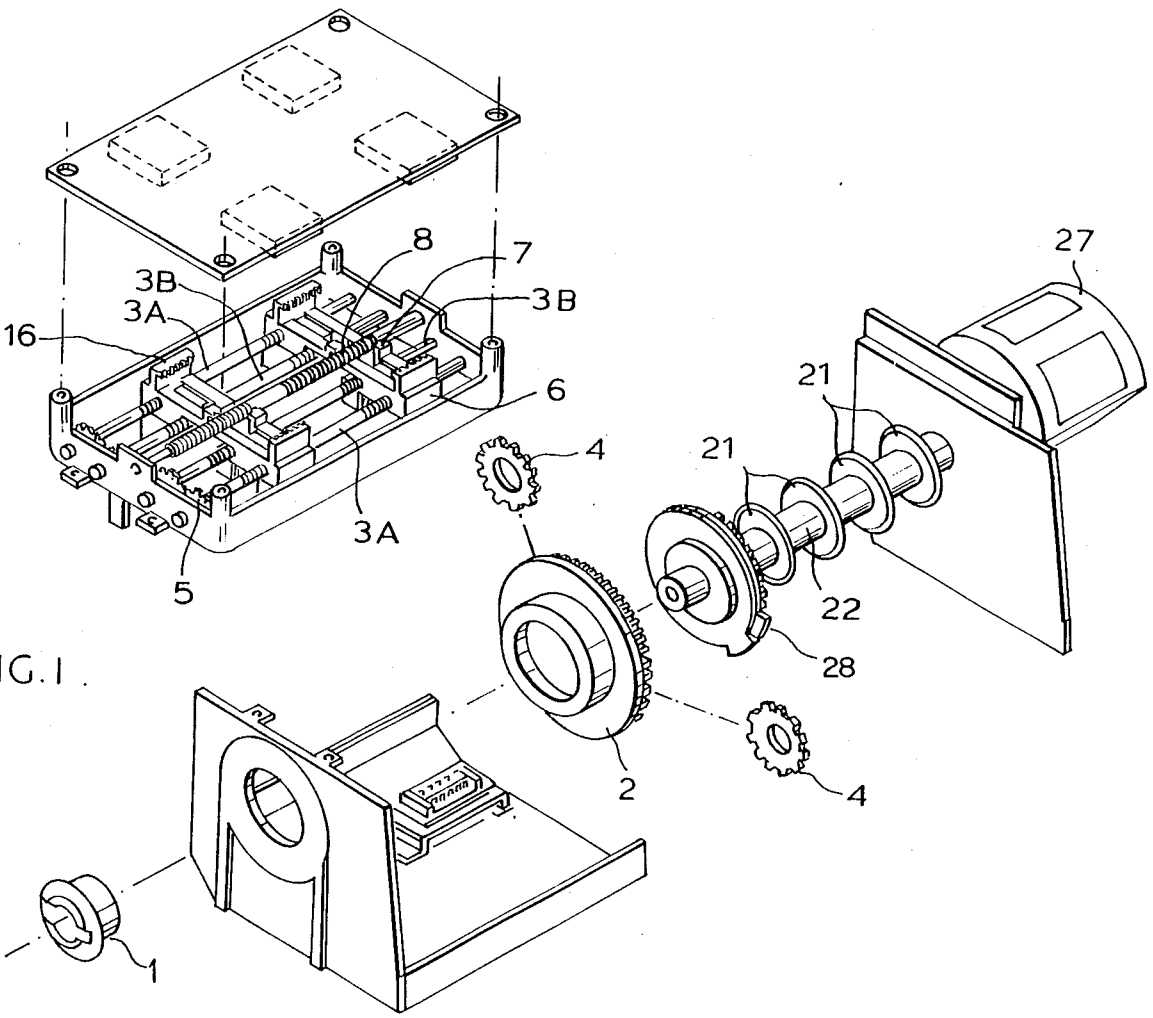
FIG. 1 is an exploded perspective view of portions of a value selector mechanism and of a printing mechanism.
Figure 2:
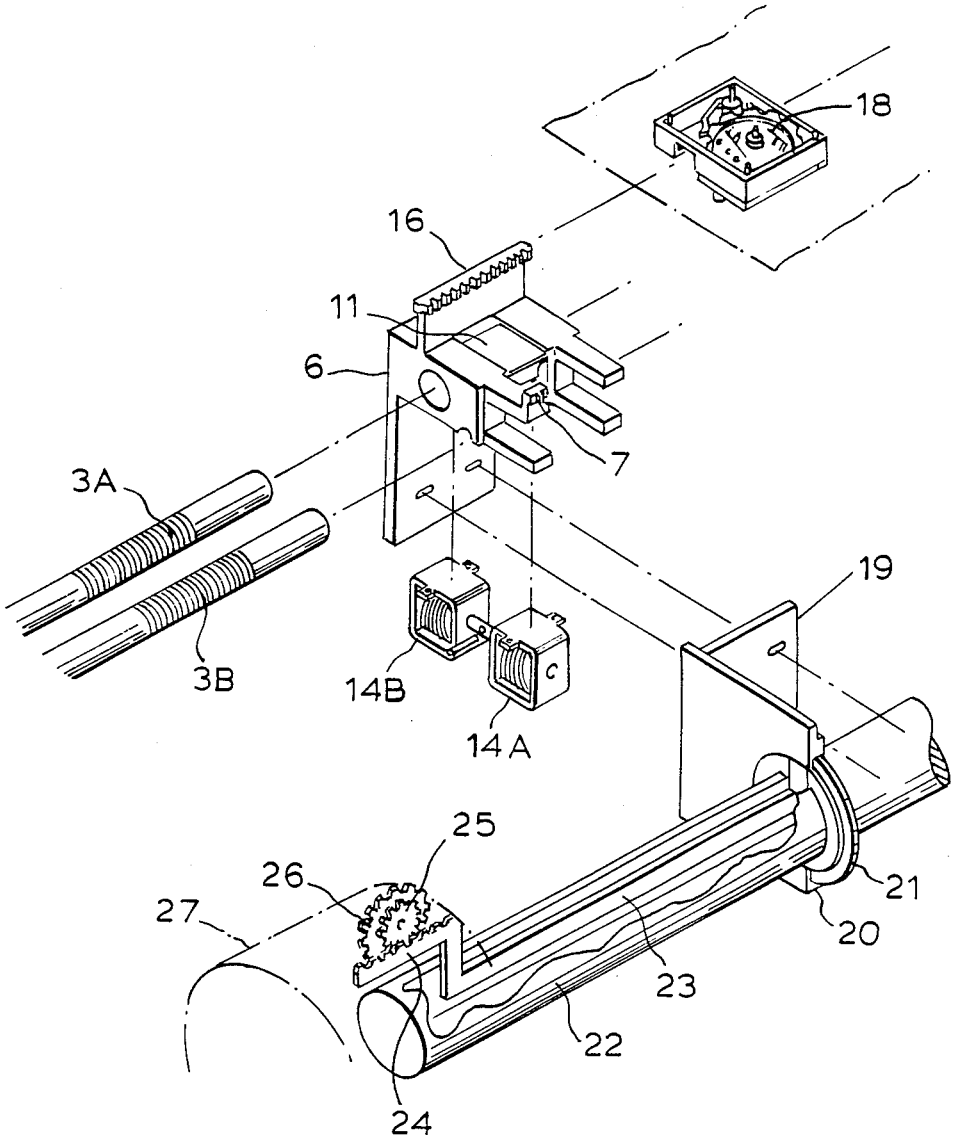
FIG. 2 is another exploded perspective view of portions of the value selector mechanism and of the printing mechanism.

When the carriages 6 have been set in the positions corresponding to this new value, a shaft 8 (FIG. 4), of elliptical cross-section and formed with a series of peripheral grooves as shown in FIG. 1, is actuated to lock the carriages 6 in their set positions. The shaft 8 is held in its locking position with the major axis of its cross section horizontal by a torsion spring 9 (FIG. 3). In this position four projecting teeth 7 respectively on the carriages 6 are held in registering grooves in the shaft 8. However, to allow the carriages to be fed along the lead screws for setting a further value, a solenoid 10 mechanically connected to the shaft 8, is energized for an appropriate time to enable the carriage movement to be completed. This holds the shaft 8 with its cross-sectional major axis vertical leaving the projection 7 clear. When the appropriate further values are detected on the encoding switches 18, the solenoids 14A, 14B are de-energized so that the springs 13 return the rockers 11 to their central positions. The solenoid 10 is then also de-energized and the elliptial locking shaft 8 rotates into mesh with the projecting tooth 7 on each carriage 6, ensuring correct carriage positioning and preventing unwanted subsequent carriage movement.

The engagement of the teeth 7 with the shaft 8 determines the correct final position of each carriage 6 and this occurs very slightly after the release of the rocker 11 from the lead screw 3A or 3B. As the encoding switches 18 described in the aforesaid specification No. 2034991 do not involve accurate means for sensing position within any individual encoded value, the initiation of the input signal from the encoding switch 18 is arranged to be in advance by a known amount of time of the moment when the carriage 6 is arrested. This enables correct de-energisation of the solenoid 14A or 14B under control of the microcomputer within the final positioning capability of the teeth 7. As an alternative, the encoding switch 18 and the aforesaid locking means may be used with an optical position detector whereby the solenoid 14A or 14B can only be deenergised at precisely defined positions in its path.

Figure 6:
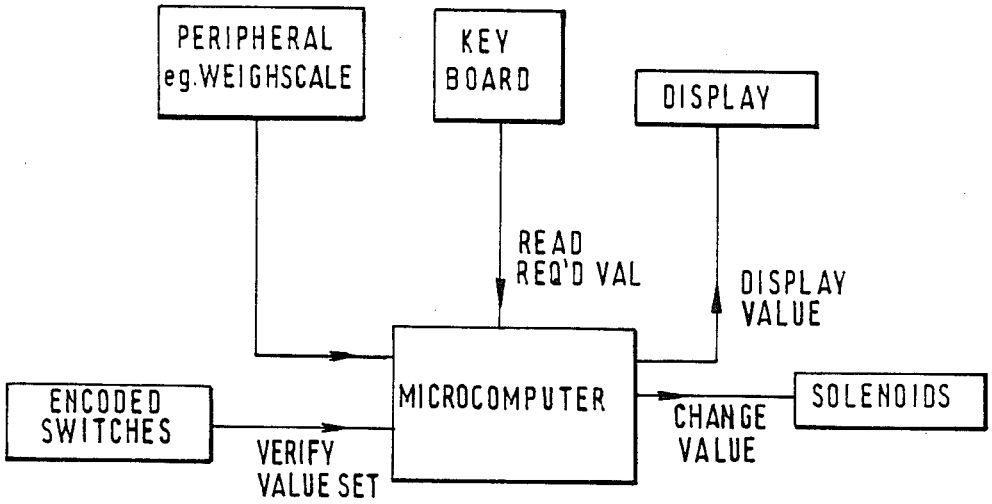
FIG. 6 is a block diagram showing an electrical control circuit for the value selector mechanism.

The solenoids 14A, 14B for the selector mechanism are controlled by an output from a microcomputer or central processing unit (CPU), as shown in FIG. 6. The value to be selected is entered at a keyboard which is, in turn, input to the CPU. Also, the value on the encoding switches 18 is input to the CPU in order to determine the current position of the selector mechanism, and from the two values the CPU software calculates the movement required by each digit to reach the new value. The respective solenoids 14A, 14B are then energised to give the required movement confirmed by feedback from the encoding switches 18 to the CPU. The new value is displayed and the value in the encoding switches 18 is monitored to check that the selector mechanism has responded correctly. An error condition is displayed in the event of a malfunction. The above procedure need not be restricted to value selection at the keyboard. As shown in FIG. 6, this may also be from some electronic peripheral equipment, for example, a weighscale. Once the value to be selected is input to the CPU, the selection procedure is the same as that described above.

Figure 7:
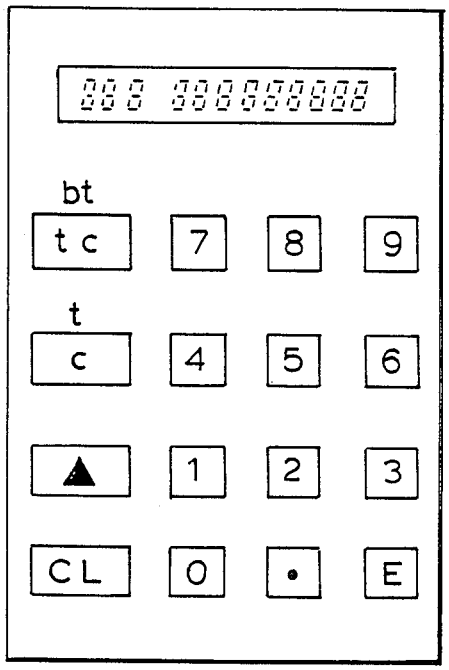
FIG. 7 is a plan of a keyboard for a franking machine.

A typical keyboard layout is shown in FIG. 7, and consists of a numeric keypad, along with a set of keys whose functions are similar to the keys on the existing Roneo Alcatel franking meters.

We claim:

1. A postal franking machine comprising a continuously driven rotary power transmission means; a printing drum; printing elements carried by said printing drum and settable to print a selected value; means selectively operable to connect the drum to said transmission means to rotate the drum through one revolution to effect a printing cycle; a pair of lead screws extending parallel to one another; means coupling said lead screws to said rotary power transmission means to effect continuous rotation of said lead screws by said power transmission means, said lead screws being rotated in opposite directions; print element setting means for each printing element; each said print element setting means including a carriage connected to the associated print element and movable in a direction lengthwise of said lead screws; and value setting means selectively operable to connect the carriage with a selected one of said lead screws to move the carriage to a position such as to set the print element associated with that setting means to print a selected value.

2. A postal franking machine including a rotatable print drum; print elements carried by said drum and settable to print a desired value; a plurality of print element setting means for setting the print elements; a pair of parallel counter-rotatable lead screws; a plurality of carriages connected respectively to said setting means and each movable lengthwise of said lead screws; power transmission means for rotating said lead screws; a single revolution clutch coupling said drum to said transmission means; and value selection means operable to connect said carriages selectively and independently to a selected one of said lead screws to effect movement of said carriages in selected directions to positions in which said print elements are set by said respective setting means to print selected values.

3. A postal franking machine as claimed in claim 2 including electronic control means operative to control operation of said value selection means.

4. A postal franking machine as claimed in claim 3 including sensing means operative to generate electrical signals indicative of the positions of said carriages and in which said control means is operative in response to said electrical signals to control operation of said value selection means.

5. A postal franking machine as claimed in claim 2 wherein said value selection means includes a pair of partial nuts on each carriage and means to move a selected one of said nuts into driving engagement with a selected one of said lead screws.

6. A postal franking machine as claimed in claim 2 wherein said value selection means includes a pair of partial nuts on each carriage and solenoids on each carriage selectively operable to move a selected one of said nuts into driving engagement with a selected one of said lead screws.

7. A postal franking machine as claimed in claim 2 including locking means controllable to lock said carriages against movement, said locking means comprising a shaft of elliptical cross section extending parallel to said lead screws and formed with transverse grooves spaced along its length; teeth on said carriages; and means to rotate said shaft between a first position in which said teeth on said carriages engage in said grooves to lock the carriages from movement and a second position in which the teeth are disengaged from the grooves and the carriages are free to move.

* * * * *